US006052921A

United States Patent [19]

Oreck

[11] Patent Number: 6,052,921

[45] **Date of Patent: *Apr. 25, 2000**

[54] SHOE HAVING LACE TUBES

[76] Inventor: Adam H. Oreck, 20 Second St. NE. #2505, Minneapolis, Minn. 55413

[ * ] Notice: This patent issued on a continued prosecution application filed under 37 CFR 1.53(d), and is subject to the twenty year patent term provisions of 35 U.S.C. 154(a)(2).

[21] Appl. No.: 09/056,994

[22] Filed: Apr. 8, 1998

Related U.S. Application Data

[62] Division of application No. 08/638,841, Apr. 29, 1996, abandoned, which is a continuation of application No. 08/601,839, Feb. 15, 1996, abandoned, which is a continuation of application No. 08/202,896, Feb. 28, 1994, abandoned.

[51] Int. Cl.[7] ..... A43C 11/00; A43B 23/26

[52] U.S. Cl. ..... 36/50.1; 36/58.5; 36/54

[58] Field of Search ..... 36/50.1, 58.5, 36/58.6, 54

[56] References Cited

U.S. PATENT DOCUMENTS

| | | |
|---|---|---|
| 167,829 | 9/1875 | Dennett . |
| 460,743 | 10/1891 | Dickson, Jr. . |
| 967,064 | 8/1910 | Savage . |
| 1,022,808 | 4/1912 | Woods . |
| 1,190,305 | 7/1916 | Leichter . |
| 1,466,673 | 9/1923 | Solomon et al. . |
| 1,683,465 | 9/1928 | Hill . |
| 1,899,754 | 2/1933 | Glidden et al. . |
| 2,121,907 | 6/1938 | Easton . |
| 2,143,556 | 1/1939 | Hodaly . |
| 2,635,361 | 4/1953 | Ayers . |
| 2,891,328 | 6/1959 | Volk . |
| 3,169,325 | 2/1965 | Fesl . |
| 3,691,658 | 9/1972 | DePerno et al. . |
| 3,703,775 | 11/1972 | Gatti . |
| 4,053,995 | 10/1977 | Shein . |
| 4,107,857 | 8/1978 | Devlin . |
| 4,366,631 | 1/1983 | Larsen et al. . |
| 4,592,154 | 6/1986 | Oatman . |
| 5,042,119 | 8/1991 | Williams . |
| 5,184,378 | 2/1993 | Batra . |
| 5,269,078 | 12/1993 | Cochrane . |
| 5,349,764 | 9/1994 | Posner . |
| 5,400,529 | 3/1995 | Bell et al. . |

FOREIGN PATENT DOCUMENTS

| | | |
|---|---|---|
| 148296 | 8/1936 | Austria . |
| 1041295 | 10/1978 | Canada . |
| 342593 | 9/1904 | France . |
| 1087129 | 2/1955 | France . |
| 2688121 | 9/1993 | France . |
| 1675440 | 4/1954 | Germany . |
| 18 75 052 | 7/1963 | Germany . |
| 35 01 596 | 7/1986 | Germany . |
| 3242105 | 10/1991 | Japan . |
| 21995 | of 1903 | United Kingdom . |
| 7425 | of 1908 | United Kingdom . |
| 110978 | 12/1917 | United Kingdom . |
| 1003969 | 9/1965 | United Kingdom . |
| 1293925 | 10/1972 | United Kingdom . |

*Primary Examiner*—Ted Kavanaugh
*Attorney, Agent, or Firm*—Steven E. Kahm

[57] ABSTRACT

This invention relates to a shoe having an ergometric shoe lace design. The laces pass through tubes on the tongue portion of the shoe and extend down to the sole of the shoe on either side of the shoe where they pass through tubes on or near the perimeter of the sole. The laces criss cross the foot in this manner to secure the foot from up and down motion in the shoe. Optionally the lace may continue to be wrapped around the heel of the foot through ankle tubes and heel tubes to secure the foot from toe to heel movement in the shoe. This is particularly of advantage for shoes used in sporting activities. In this manner the upper of the shoe is not pulled together on either side of the tongue as in conventional shoes, thus avoiding stresses in the upper that tend to put pressure on and rub against the user's foot. Thus the shoe is comfortably and securely held to the users foot.

6 Claims, 11 Drawing Sheets

SHOE HAVING LACE TUBES

This application is a Divisional of application Ser. No. 08/638,841, filed Apr. 29, 1996 now abandoned, which is a Continuation of application Ser. No. 08/601,839, filed Feb. 15, 1996 now abandoned, which is a Continuation of application Ser. No. 08/202,896, filed Feb. 28, 1994 now abandoned, which applications are incorporated herein by reference.

BACKGROUND OF THE INVENTION

1. Field of the Invention

This invention relates to shoes and more particularly to the way in which shoe laces are used to ergonomically encase the foot in the shoe comfortably and securely.

2. Description of the Related Art

In the past most shoes have encased the foot of the wearer by having a tongue which serves to cover an opening in the upper which comprises two halves drawn together over the tongue and secured by laces through eyelets on the upper on either side of the tongue. The laces pull the halves of the upper tightly over the upper portion of the wearers instep and cause stress on the shoe in the region of the tongue downward to where the the upper is attached to the sole. This arrangement also causes this part of the shoe to be drawn tightly to the users foot and can cause uncomfortable rubbing or pressure on the sides of the users foot. The upper secured in this manner also secures the users foot from sliding forward in the shoe and thus secures the heel of the wearers foot to the heel of the shoe in a ball and socket type arrangement. Rearward force on the wearers foot by tightening the laces keep the foot from disengaging from the shoe. The laces also tend to pull the upper such that the heel is tightly secured to the wearers foot and stresses the upper from front to rear.

SUMMARY OF THE INVENTION

The invention uses a different way of lacing the shoe therein the laces extend from one side of the sole of the shoe across the top of the instep to the other side of the foot and to the sole of the shoe on the opposite side. The shoe laces may then be redirected across the upper to the opposite side or continue under the sole and up on the other side of the foot. Instead of eyelets in the upper, a tube is attached to the tongue to allow the laces to secure the tongue against the foot. The upper is then held against the wearer's foot by the laces surrounding the upper. In this manner there are no stress points in the upper to put pressure on or rub against the users foot, since the upper is not being stretched. Further the laces may be used to engage the wearers heel by passing from the sole of the shoe around the heel and then surround the opening of the top portion of the upper to secure the heel in the shoe. This system eliminates the stress in the upper caused by conventional lacing and the rubbing of the shoe against the wearers foot at these points.

OBJECTS OF THE INVENTION

One object of the invention is to secure a shoe to the wearers foot in a manner such as to eliminate stresses in the upper of the shoe and to thus eliminate rubbing and pressure on the wearers foot.

Another object of the invention is to create optimal security of the foot in the shoe without creating stresses in the upper.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
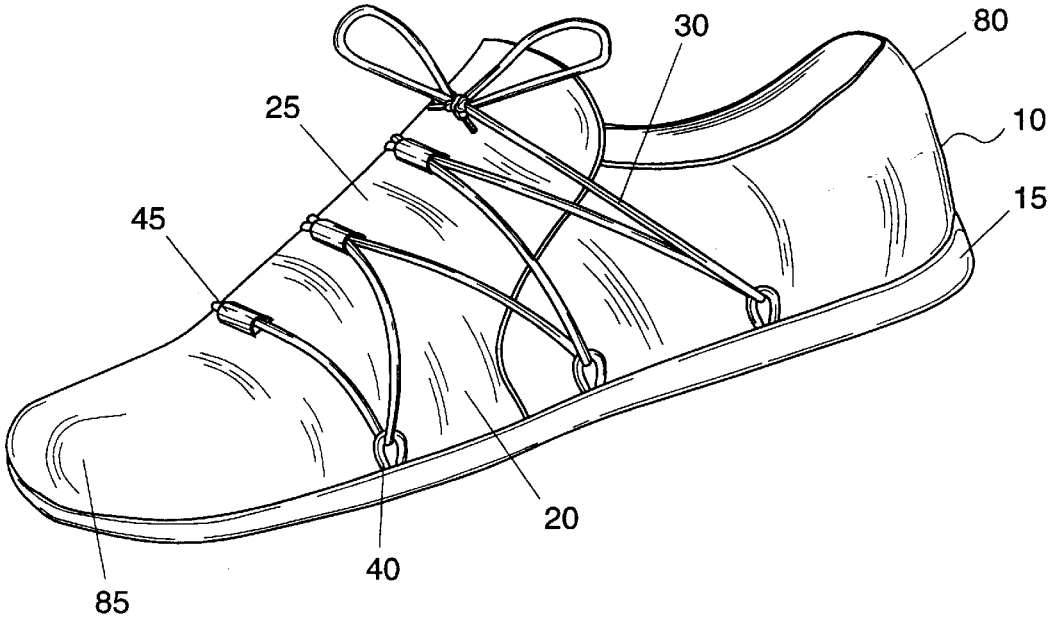
FIG. 1 is a perspective view of an embodiment with tongue tubes and sole redirection devices.

FIG. 1 shows a shoe 10 having a sole 15, an upper 20, a tongue 25, a lace 30, a redirection device 40, and a tongue tube 45. The shoe has a toe 85 and a heel 80. The shoe has conventional means of construction having a sole 15, with an upper 20, attached by conventional means well known in the art.

The shoe laces 30, secure the foot of the wearer in the shoe 10, by means of being laced through a series of tongue tubes 45 and redirection devices 40. Redirection devices 40, are positioned on the perimeter of the sole 15. Tongue tubes 45, are attached at the center of the upper 20 generally on the center of the tongue or tongue portion 25 of the shoe. By passing the lace 30, from a first tongue tube 45 nearest the toe 85 of the shoe, downward to the redirection device 40, then upward back across the upper 20 by passing though a second tongue tube 45 and down to a second redirection device, and so on, through the remainder of the redirection devices 40 and tongue tubes 45. The shoe laces may then be tied or otherwise secured at the top of the tongue. In this manner the shoe can be secured to the wearer's foot without the upper being stressed, stretched and pulled together by traditional laces in eyelets on either side of the tongue of the shoe. The laces 30, passing from the sole 15, at the base of the upper 20, across the wearers foot to the redirection device 40, at the sole 15, on the other side of the shoe moves the function of securing the shoe around the users foot from the shoe upper itself to the laces on the outside of the shoe. This eliminates the stresses in the upper which occur in conventional shoes and eliminates pressure points on the wearer's foot which may be caused by such pulling on the upper by the conventional positioning of shoe laces. Since the shoe laces in the present design are on the outside of the upper they hold the tongue down against the wearer's foot without stressing the sides of the upper. The laces being on the outside of the upper and being laid on top of the contours of the foot will not cause stresses in the upper which are pulled against and rub the wearer's foot.

As shown in FIG. 1 the shoe may be held to the wearers foot with only a lace going through redirection devices 40 and tongue tubes 45. This arrangement holds the wearers foot from coming up and out of the shoe by securing the upper 20, to the sole 15, with the wearer's foot therebetween. However in another embodiment, especially for sports shoe use, the shoe should also be secured on the foot to prevent toe 85, to heel 80, movement. In order to more securely secure the foot in the shoe so that the heel of the wearer's foot remains securely in the heel 80, of the shoe, the lace 30, may be extended from the tongue 25, through an ankle tube 50 as in FIG. 2, to a heel tube 55, and then back to the front of the shoe through a second ankle tube 50 and tied on the front of the shoe.

Figure 2:
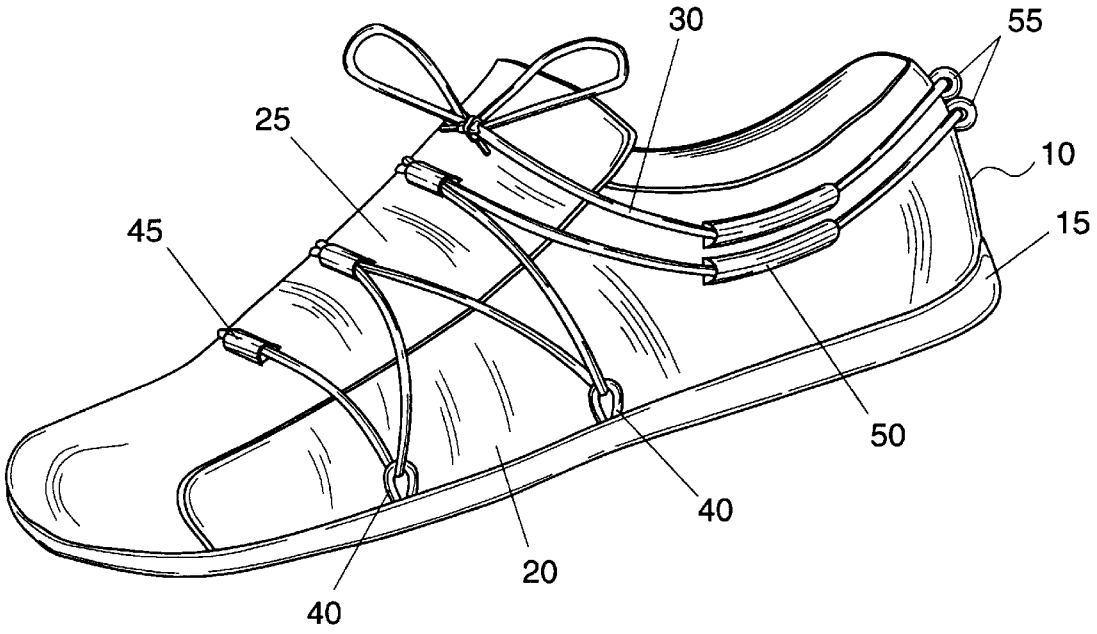
FIG. 2 is a perspective view of an embodiment of the shoe having a pair of ankle lace tubes and a pair of heel lace tubes.

In the embodiment in FIG. 2 the lace extends from a tongue tube 45, to an ankle tube 50, through a heel tube 55, then back through a second ankle tube 50 on the other side of the shoe, to the tongue 25, where the lace 30, is tied.

Figure 3:
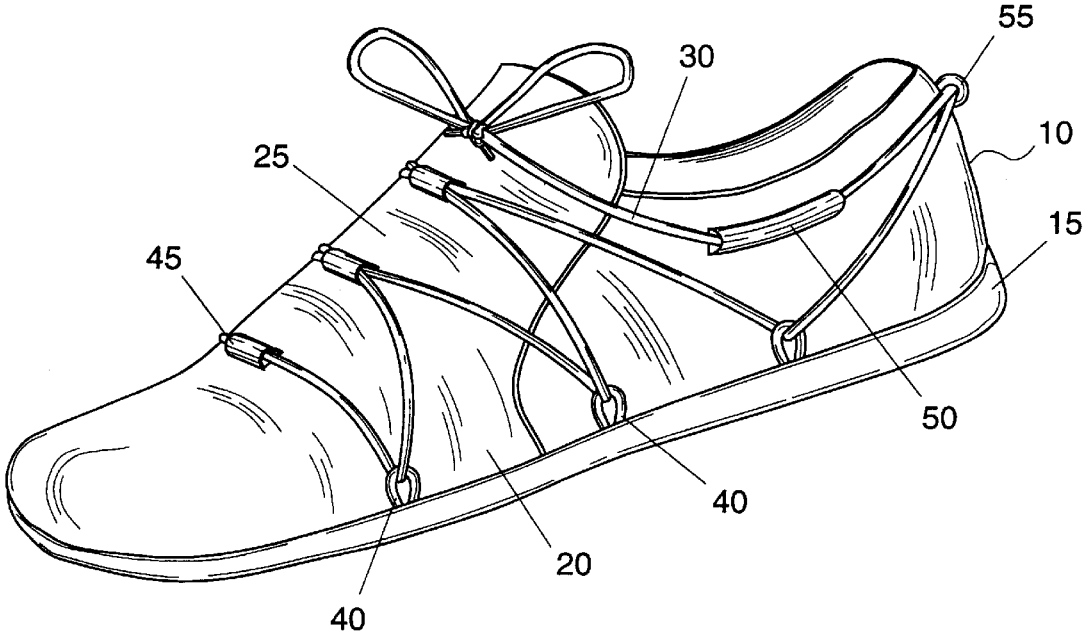
FIG. 3 is a perspective view of an embodiment of the invention having an ankle lace tube and a heel lace tube.

In the embodiment in FIG. 3 the heel of the wearers foot is secured in the shoe by the lace 30, extending from a tongue tube 45, to a redirection device 40, then through a heel tube 55 and back through an ankle tube 50, to the tongue 25, where the lace 30, is tied.

Figure 4:
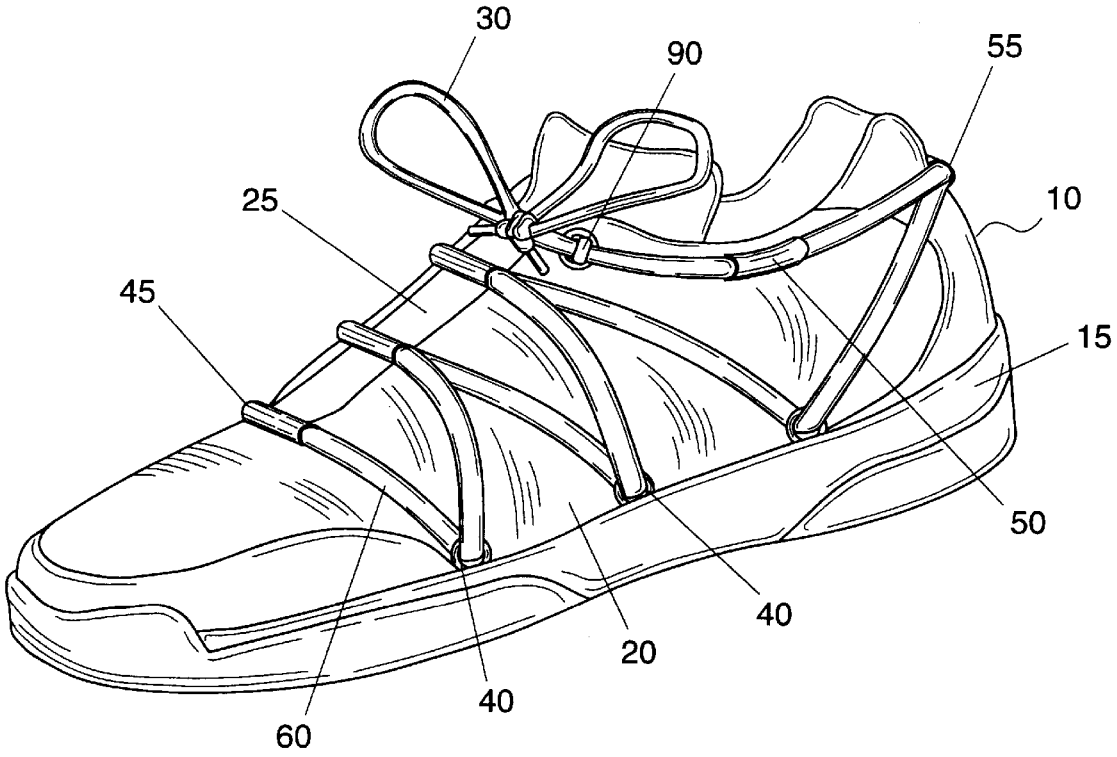
FIG. 4 is a perspective view of an embodiment of the shoe having an ankle lace tube a heel lace tube and a lace post.

In the embodiment in FIG. 4 the heel of the wearers foot is secured in the shoe by the lace running from a tongue tube 45 to a redirection device 40, to a heel tube 55 to an ankle tube 50, then through a lace post 90, attached to the upper, and then to the tongue 25 where the lace is tied.

Figure 5:
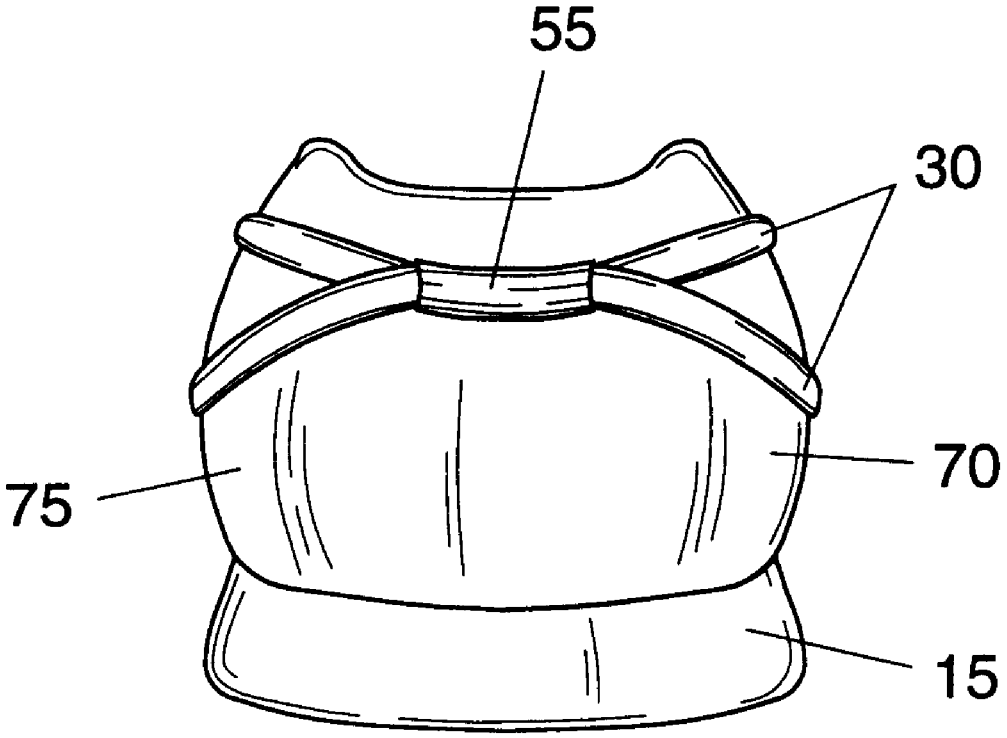
FIG. 5 is a rear view of a shoe showing a heel tube.

FIG. 5 shows the rear of the shoe featuring a heel tube 55 secured to the heel 80 of the shoe. FIG. 5 shows the first side 70 and the second side 75 of the shoe. In FIGS. 3 and 5 the heel tube a single tube with two sections of laces passing therethrough. In FIG. 2, two heel tubes are employed having a separate tube for each lace section.

Figure 6:
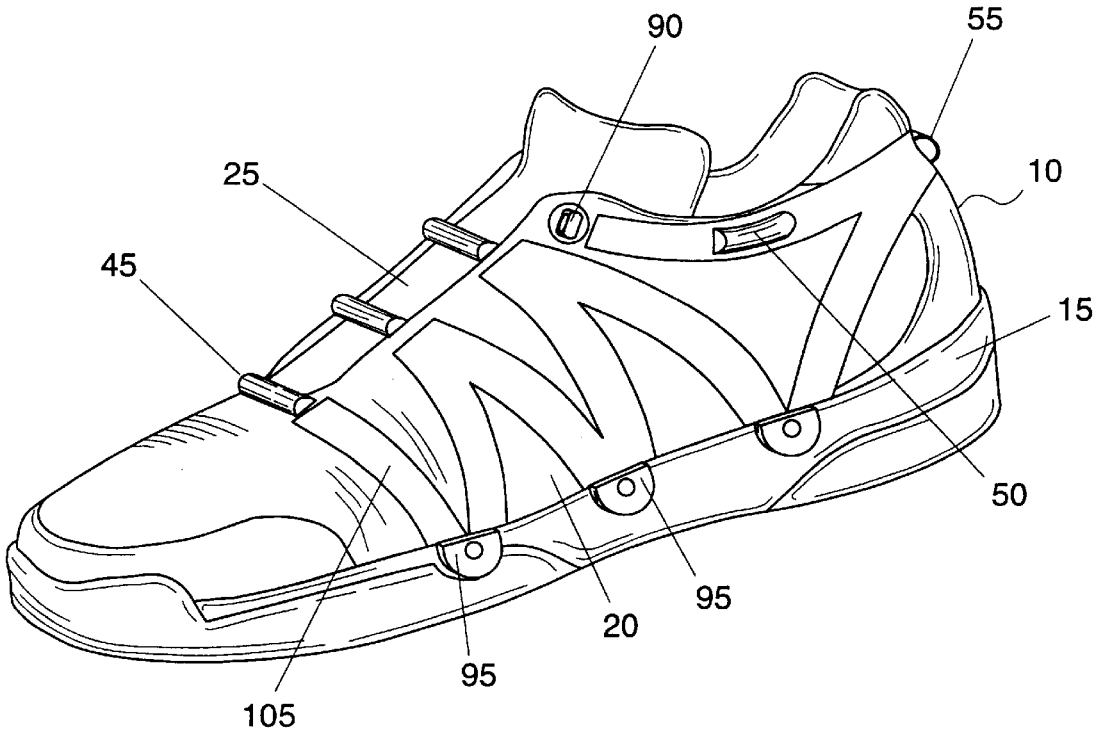
FIG. 6 is a perspective view of the shoe of FIG. 4 with a pulley type redirection device and pressure displacement strips.

FIG. 6 shows another embodiment of the invention having pressure displacement strips 105, on the upper 20, for displacing the pressure of the laces over a larger area and thus eliminating possible pressure of the laces on the wearer's foot.

Figure 7:
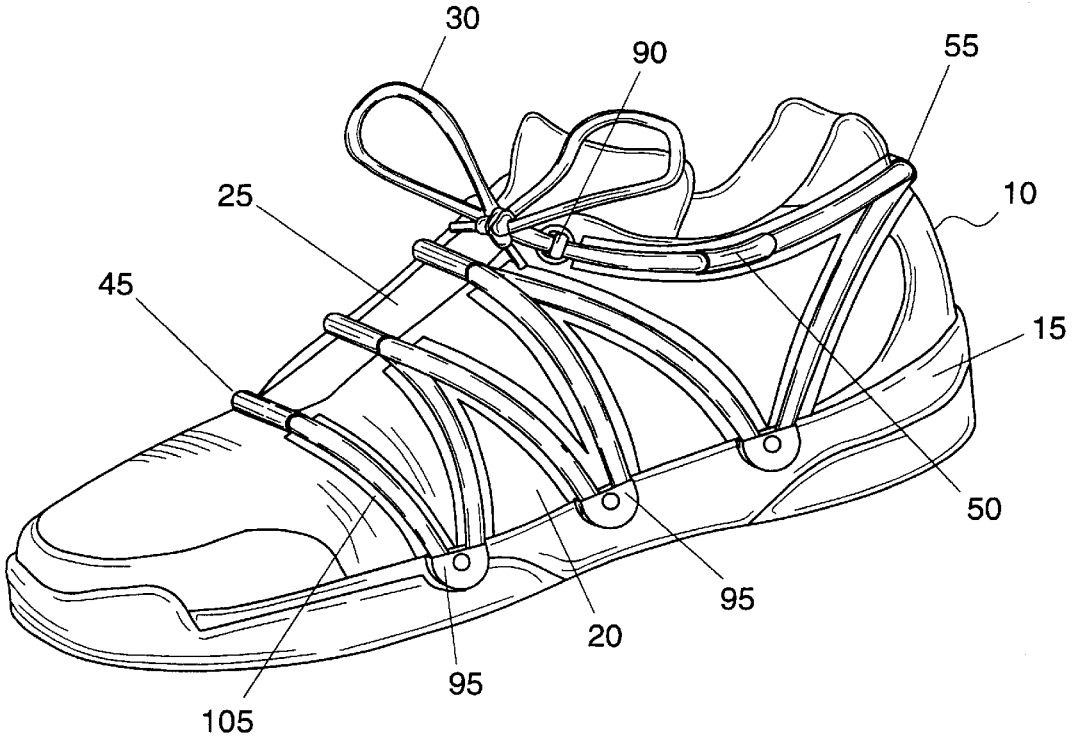
FIG. 7 is the shoe as shown in FIG. 6 with shoe laces.

FIG. 7 shows the laces on the shoe of the embodiment shown in FIG. 6. The laces 30, are on top of the pressure displacement strips.

Figure 8:
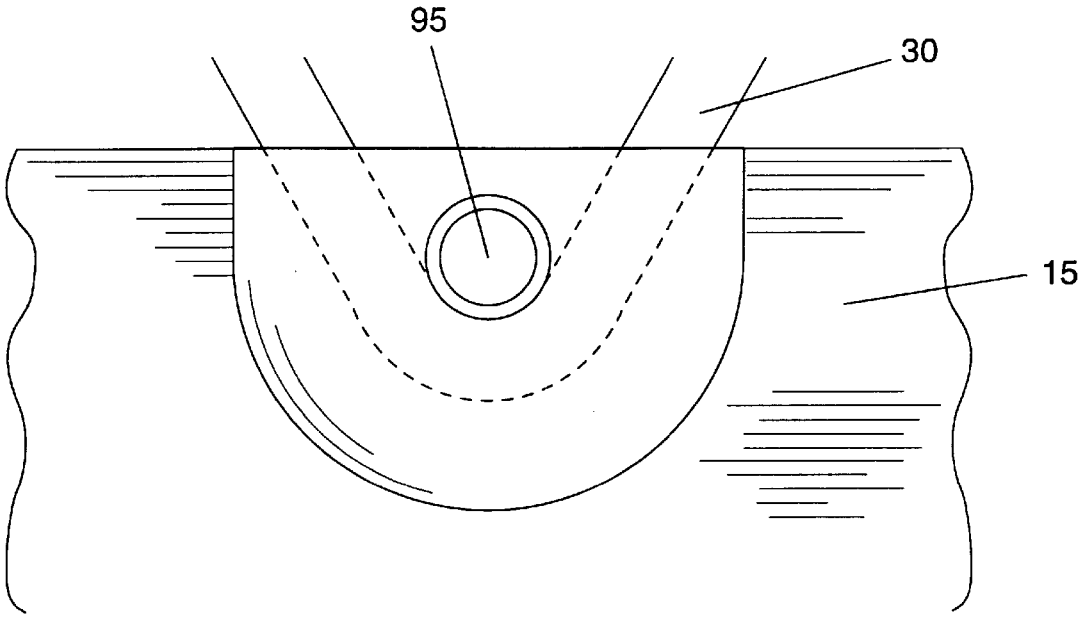
FIG. 8 is a side view of a pulley redirection device.

FIG. 8 shows a redirection device 95, having a pulley inside to make it easier to tighten the laces. The pulley type redirection devices are shown on the shoes in FIGS. 6 and 7.

Figure 9:
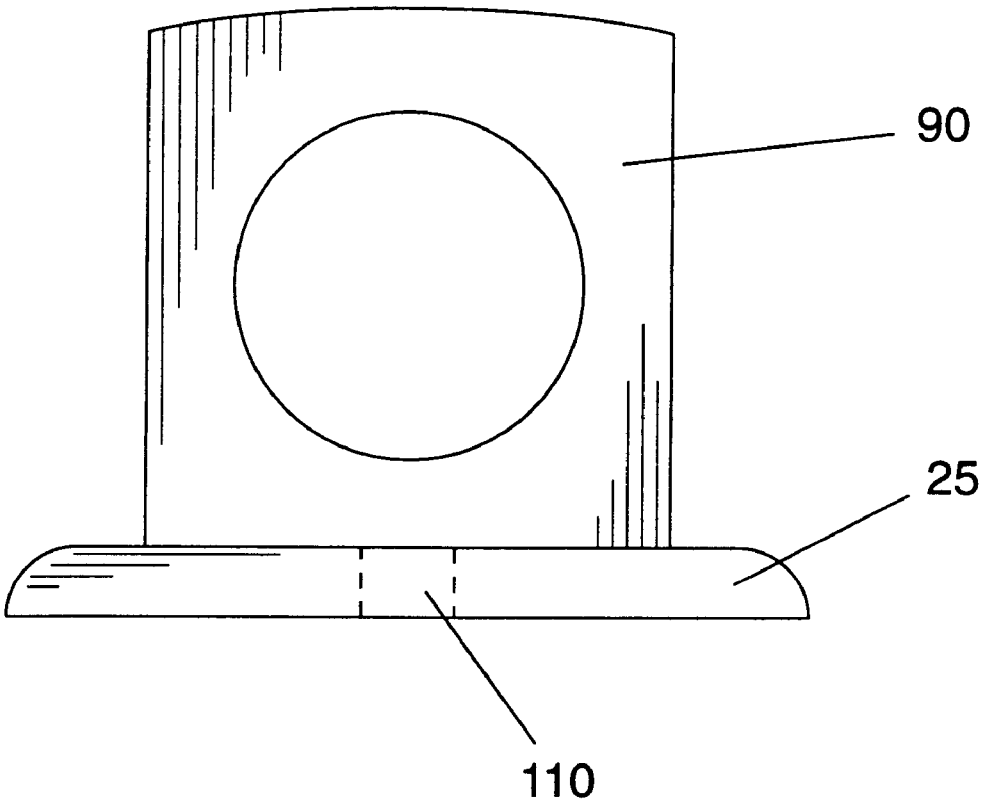
FIG. 9 is a front view of a lace post.

FIG. 9 shows a front view of the lace post 90 having an axle 110 to pivot the lace post on the upper 20. In some embodiments the lace post is placed through the tongue 25, therefore the tongue is secured in place relative to the upper when lace 30, is threaded through the lace post 90.

Figure 10:
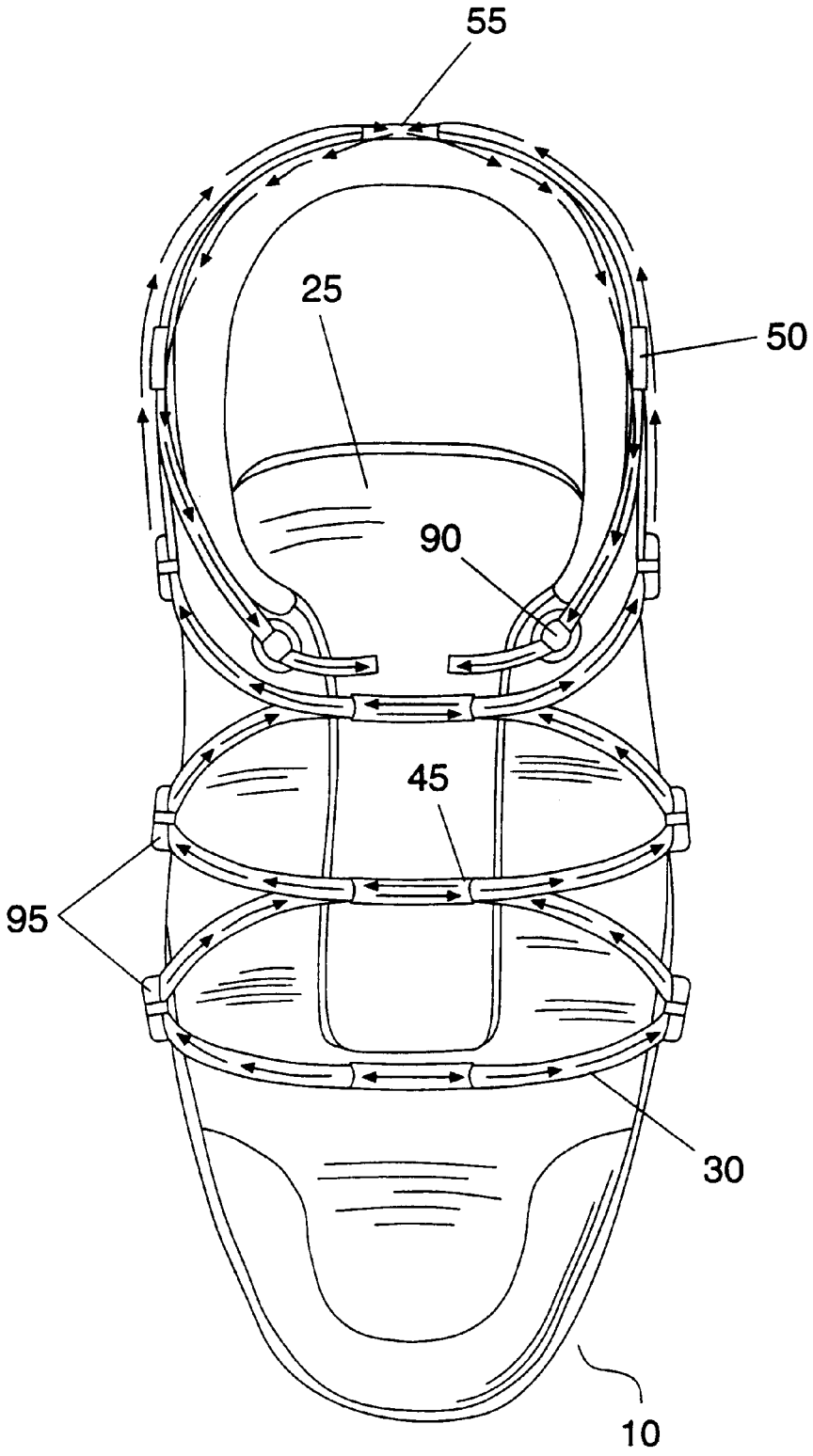
FIG. 10 is a top view of a shoe showing tension vectors in the shoe laces.

FIG. 10 shows the tension vectors in the laces 30, on the shoe. It shows how the laces carry the tension which secures the shoe to the wearer's foot. The upper 20, has no tension vectors indicating that the upper is not being stretched and pulled over the users foot. Therefore there are no pressure points on the users foot induced by a stretching upper.

Figure 11:
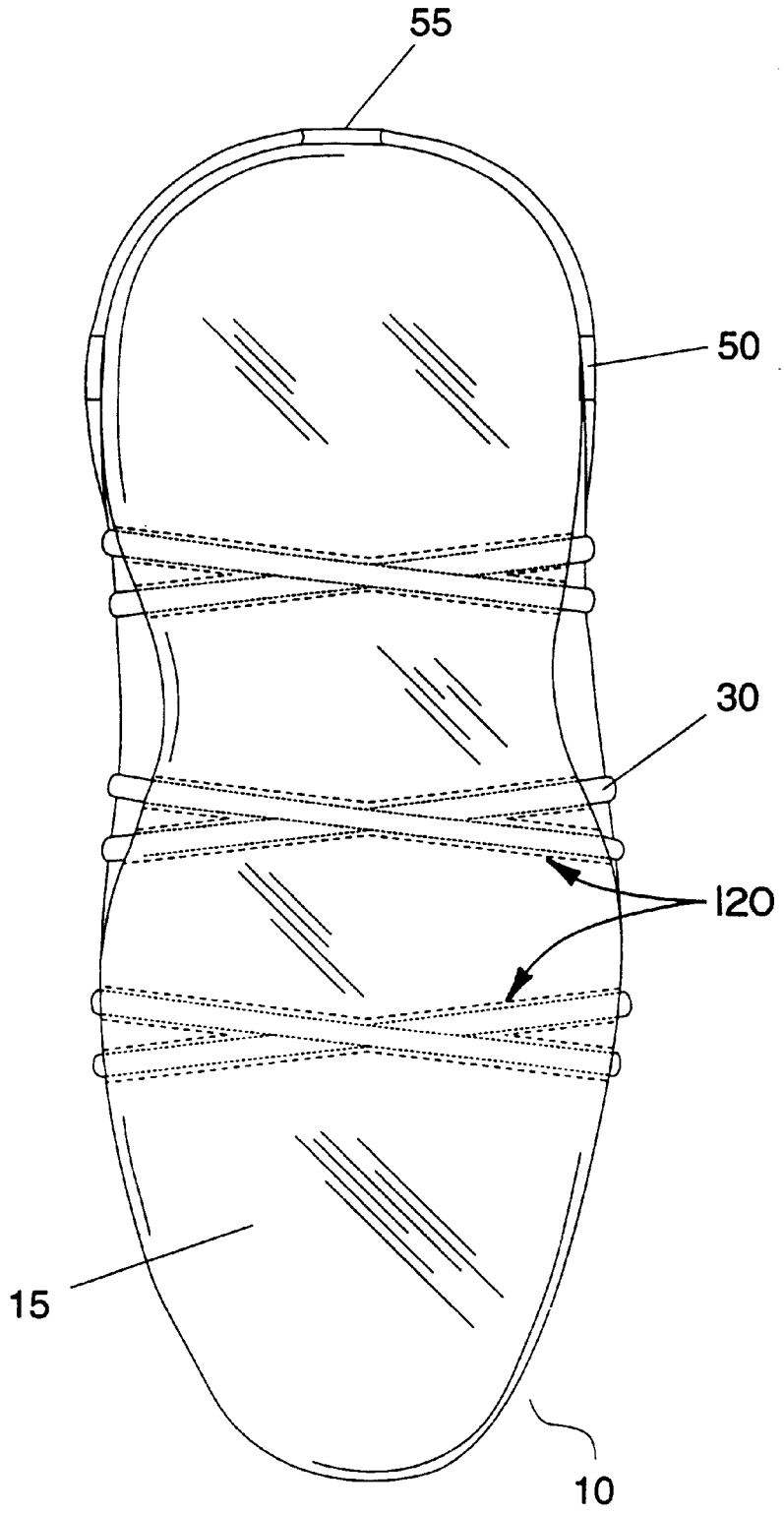
FIG. 11 is a bottom view of a shoe having the laces passing under the shoe.

FIG. 11 shows another embodiment of the invention herein the laces 30 pass through sole tubes 120, in the sole 15, of the shoe 10. By using sole tubes the laces need not be redirected back up over the upper 20 by redirection devices 40. The sole tubes allow the laces to pass under the wearer's foot and come up on the other side of the shoe, thus wrapping the users foot into the shoe.

The tongue tubes 45, redirection devices 40, ankle tubes 50, and heel tubes 55, may be semi circular having the shoe upper as one boundary and may be made of any materials which are flexible to conform the the shape of the foot. The tubes may be secured to the shoe by stitching gluing or other means of attachment.

It is to be understood that the invention is not limited to applications for shoes but may also be applied to boots, skates, ski boots and other footwear.

Obviously, many modifications and variations of the present invention are possible in light of the above teachings. It is therefore to be understood that, within, the scope of the appended claims, the invention may be practiced otherwise than as specifically described.

What is claimed is:

1. A shoe comprising:

(a) a sole including a perimeter, a left side, a right side, a toe and a heel;

(b) an upper having a base attached to said sole, said upper extending from the base upward to provide an enclosure for receiving a foot, the enclosure includes a toe region, a ball region, a tongue region, and a heel region, the upper having a substantially vertical left side portion, a substantially vertical right side portion extending up from the sole, a substantially horizontal area over the top of the toe region and an upward sloping portion in the tongue region;

(c) a tongue in the tongue region extended from said upper at the toe region slopping upward toward the heal region;

(d) a plurality of redirection devices provided along the right side of the upper between the ball region and the heel region;

(e) a plurality of redirection devices provided along the left side of the upper between the ball region and the heel region; the redirection devices located above the sole on the vertical portion of the right and left sides of the upper and substantially below the horizontal portion of the upper such that a lace extending between the redirection devices from the right side to the left side of the upper will pull upward on the redirection devices adding stress to the upper in the upward direction between the redirection devices and the sole on the lower portion of the upper below the redirection devices and thus not pull the upper laterally between the right and left sides of the shoe avoiding lateral stresses in the upper and pressure of the upper on a wearer's foot;

(f) the lace extending between foremost redirection devices provided on the left side of the upper and the right side of the upper and extending from the foremost redirection devices across the upper and tongue to second foremost redirection device provided on the left side of the upper and the right side of the upper and continuing until all of said plurality of redirection devices are laced, wherein:

(i) the lace wrapping the left side of the upper and the right side of the upper; and (ii) the interaction of the lace and redirection devices providing side support for said shoe, the lace laying over the upper provides lateral connection between the right and left side of the upper to secure the shoe to the foot, the stress on the laces being over the upper does not place lateral stress on the upper reducing stresses in the upper and pressure points on a wearer's foot found in conventional shoes which include a lace extending through eyelets.

2. A shoe according to claim 1, further comprising:

(a) a loop attached to the upper at the heel region and extending away from the upper, and wherein the lace extends through the loop attached to the upper at the heel region.

3. A shoe according to claim 2, wherein the upper has an ankle region and at least one ankle tube on the right side of the upper and at least one ankle tube on the left side of the upper for guiding the lace to and from and the loop at the heel region to secure the shoe on the wearer from toe to heal.

4. A shoe according to claim 1, further comprising:

(a) a plurality of tubes attached to the tongue, and wherein the lace extends through the plurality of tubes.

5. A shoe according to claim 4, wherein the tubes extend substantially laterally across the tongue width.

6. A shoe according to claim 1, wherein the redirection devices are proximate the sole.

* * * * *